US009744593B2

(12) United States Patent
Nishimoto et al.

(10) Patent No.: US 9,744,593 B2
(45) Date of Patent: Aug. 29, 2017

(54) SILVER POWDER AND METHOD FOR PRODUCING SAME

(71) Applicant: SUMITOMO METAL MINING CO., LTD., Tokyo (JP)

(72) Inventors: Masamu Nishimoto, Ehime (JP); Yoshihiro Okabe, Ehime (JP); Satoshi Kanada, Ehime (JP)

(73) Assignee: SUMITOMO METAL MINING CO., LTD., Tokyo (JP)

( * ) Notice: Subject to any disclaimer, the term of this patent is extended or adjusted under 35 U.S.C. 154(b) by 462 days.

(21) Appl. No.: 14/382,375

(22) PCT Filed: Feb. 27, 2013

(86) PCT No.: PCT/JP2013/055134

§ 371 (c)(1),
(2) Date: Sep. 2, 2014

(87) PCT Pub. No.: WO2013/133103

PCT Pub. Date: Sep. 12, 2013

(65) Prior Publication Data

US 2015/0099136 A1 Apr. 9, 2015

(30) Foreign Application Priority Data

Mar. 7, 2012 (JP) ..... 2012-050600

(51) Int. Cl.

| | |
|---|---|
| ***B22F 9/24*** | (2006.01) |
| ***B22F 1/00*** | (2006.01) |
| ***C22C 5/06*** | (2006.01) |

(52) U.S. Cl.

CPC ..... *B22F 9/24* (2013.01); *B22F 1/0003* (2013.01); *B22F 1/0011* (2013.01); *C22C 5/06* (2013.01); *Y10T 428/12014* (2015.01)

(58) Field of Classification Search

None

See application file for complete search history.

(56) References Cited

U.S. PATENT DOCUMENTS

2009/0023007 A1* 1/2009 Fujimoto ..... B22F 1/0044 428/546
2009/0214766 A1 8/2009 Magdassi et al.

FOREIGN PATENT DOCUMENTS

JP 10-308118 * 11/1998
JP A-10-317022 12/1998

(Continued)

OTHER PUBLICATIONS

International Search Report issued in International Application No. PCT/JP2013/055134 mailed May 21, 2013.

*Primary Examiner* — Jessee Roe
*Assistant Examiner* — Ngoclan T Mai
(74) *Attorney, Agent, or Firm* — Oliff PLC

(57) ABSTRACT

A method for producing silver powder wherein a silver solution containing a silver complex and a reductant solution are continuously mixed to provide a reaction liquid, the method including: a step of preparing a silver nucleus solution wherein a silver solution for nucleation which contains a silver complex, a solution containing a strong reductant, and a dispersant are mixed to provide the silver nucleus solution; a step of preparing a reductant solution containing nuclei wherein the silver nucleus solution obtained and a weak reductant having a standard electrode potential higher than that of the strong reductant are mixed to obtain the reductant solution containing nuclei; and a step of growing particles wherein the reductant solution containing nuclei and a silver solution for particle growth containing a silver complex are continuously mixed to provide a reaction solution, in which the silver complex is reduced to thereby grow silver particles.

12 Claims, 7 Drawing Sheets

(56) References Cited

FOREIGN PATENT DOCUMENTS

| | | |
|---|---|---|
| JP | A-2007-270312 | 10/2007 |
| JP | A-2008-527169 | 7/2008 |
| JP | A-2009-140788 | 6/2009 |
| JP | A-2010-43337 | 2/2010 |
| JP | A-2010-70793 | 4/2010 |
| JP | A-2010-225575 | 10/2010 |

* cited by examiner

SILVER POWDER AND METHOD FOR PRODUCING SAME

FIELD OF THE INVENTION

The present invention relates to a method for producing silver powder, and more specifically to a method for producing silver powder which mainly constitutes resin silver pastes and calcined silver pastes used for forming wiring layers and electrodes of electronic devices. The present application asserts priority rights based on JP Patent Application 2012-050600 filed in Japan on Mar. 7, 2012. The total contents of disclosure of the patent application of the senior filing date are to be incorporated by reference into the present application.

BACKGROUND OF THE INVENTION

Silver pastes such as resin silver pastes and calcined silver pastes are often used for forming wiring layers, electrodes and the like in electronic devices. Such silver pastes are thermally cured or calcined after applied or printed to thereby form conductive films that serve as wiring layers, electrodes and the like.

For example, a resin silver paste is composed of silver powder, a resin, a curing agent, a solvent and the like. The paste is printed on conductor circuit patterns or terminals, thermally cured at 100° C. to 200° C. to form conductive films, which are used to form wiring and electrodes. Alternatively, a calcined silver paste is composed of silver powder, glass, a solvent and the like. The paste is printed on conductor circuit patterns or terminals, thermally calcined at 600° C. to 800° C. to form conductive films, which are used to form wiring and electrodes. On the wiring and electrodes formed by these silver pastes, silver powder is disposed in lines to form electrically-connected current paths.

Silver powder used for silver pastes has a particle diameter of 0.1 μm to several μm, which varies depending on the thickness of wiring and electrodes to be formed. Alternatively, homogeneous distribution of silver powder in a paste enables formation of wiring and electrodes having a homogeneous thickness.

Although characteristics required for the silver powder for silver pastes vary depending on applications and use conditions, it is common and important for the powder to have a homogeneous particle diameter, little aggregation, and a high dispersibility in pastes. When the silver powder has a homogeneous particle diameter and high dispersibility in pastes, curing or calcination proceeds homogeneously to thereby permit formation of conductive films having low resistance and high strength. When the powder has non-homogeneous particle diameter and poor dispersibility, silver particles are not homogeneously present in a printed film. Thus, not only thicknesses of wiring and electrodes, but also curing and calcination become non-homogeneous, so that it is likely that conductive films have increased resistance or become brittle and fragile.

Furthermore, an important requirement for the silver powder for silver pastes is to be produced at a low cost. This is because silver powder, which is a main component of pastes, accounts for a large proportion of the price of the pastes. In order to reduce a manufacturing cost, it is important not only a low unit price of raw materials or materials to be used, but also low treatment-costs of waste fluid and exhaust gas.

In production of the silver powder described above which is used for silver pastes, a raw material commonly used as the silver source is silver nitrate. For example, Patent Document 1 discloses a method for obtaining homogeneous silver powder, wherein the method includes continuously mixing a solution containing a silver amine complex, which is provided by dissolution of silver nitrate in ammonia, and a reductant solution.

According to the production method shown in the Patent Document 1, it is possible to obtain granular silver powder which has an average particle diameter of 0.1 to 1 μm, is homogeneous, and is difficult to aggregate. However, silver nitrate emits poisonous nitrous acid gas in the course of dissolution in ammonia water and the like, so that a device for recovering the gas is required. Alternatively, a large amount of nitric nitrogen and ammonia nitrogen is included in the effluent, and thus a device for treating the nitrogen is also required. Additionally, silver nitrate is a hazardous substance as well as a deleterious substance, and thus it is necessary to handle carefully. In this way, when silver nitrate is used as a raw material of silver powder, a problem exists that influences and risks of silver nitrate on the environment are more severe than those of other silver compounds.

Accordingly, a method for producing silver powder is also suggested, wherein silver chloride is reduced without using silver nitrate as the raw material. When silver chloride is used, there exist advantages, such as lower disposal costs and lower environmental risks because no nitrous acid gas is emitted when silver chloride is dissolved in ammonia water. Additionally, silver chloride is neither a hazardous substance nor a deleterious substance, and has an advantage of being a silver compound relatively easy to handle although requiring light shielding. Silver chloride is also an intermediate of a silver purification process and has purity sufficient for electronics industry.

Patent Document 2 discloses a method for obtaining silver powder, wherein silver chloride is dissolved in ammonia water to provide a silver solution, to which a dispersant and a silver particle slurry are added, and then a reductant, hydrazine is added. However, the particle diameter of the silver powder obtained by this method was 0.2 to 3 μm and had a problem in the homogeneity.

PRIOR-ART DOCUMENTS

Patent Document

PTL 1: Japanese Patent Application Laid-Open No. 2010-070793

PTL 2: Japanese Patent Application Laid-Open No. 2010-043337

SUMMARY OF THE INVENTION

In view of such conventional circumstances, an object of the present invention is to provide a method for producing silver powder, wherein the method enables production of silver powder having a homogeneous particle diameter with high productivity.

The present inventors have found that, as the result of intensive studies to achieve the object described above, generation of silver nuclei and growth of particles from the silver nuclei are greatly influenced by reduction power of a reductant (a standard electrode potential), thereby leading the present invention.

That is, the method for producing silver powder in accordance with the present invention is a method for producing silver powder wherein a silver solution containing a silver complex and a reductant solution are continuously mixed to provide a reaction liquid, in which the silver complex is reduced to obtain a silver particle slurry, and then, silver powder is produced via steps of filtration, washing, and drying, the method including: a step of preparing a silver nucleus solution wherein a silver solution for nucleation which contains a silver complex, a solution containing a strong reductant, and a dispersant are mixed to obtain the silver nucleus solution; a step of preparing a reductant solution containing nuclei wherein the silver nucleus solution obtained and a weak reductant having a standard electrode potential higher than that of the strong reductant described above are mixed to obtain a reductant solution containing nuclei; and a step of growing particles wherein the reductant solution containing nuclei described above and a silver solution for particle growth containing a silver complex are continuously mixed to provide a reaction solution, in which the silver complex is reduced to thereby grow silver particles.

The equivalent of the strong reductant herein is preferably 2.0 or more and less than 4.0 with respect to the amount of silver in the silver solution for nucleation described above.

The standard electrode potential of the strong reductant described above is preferably 0.056 V or less, and the difference of the standard electrode potential between the strong reductant described above and the weak reductant described above is preferably 1.0 V or more. Specifically, it is preferable that hydrazine monohydrate is used as the strong reductant described above and ascorbic acid is used as the weak reductant described above.

The silver concentration in the silver solution for nucleation above described is preferably 0.1 to 6.0 g/L and more preferably 0.1 to 1.0 g/L. The silver concentration in the silver solution for particle growth described above is preferably 20 to 90 g/L.

The silver complex described above is preferably a silver amine complex, which is obtained by dissolving silver chloride in ammonia water. The molar ratio of the amount of ammonia with respect to the amount of silver in the silver solution for nucleation described above is preferably 20 to 100.

The amount of the dispersant described above to be mixed is preferably 1 to 30% by mass with respect to the amount of silver in the silver solution for particle growth after mixing of the reductant solution containing nuclei and the silver solution for particle growth described above. As the dispersant, at least one selected from polyvinyl alcohol, polyvinyl pyrrolidone, modified silicone oil surfactants, and polyether surfactants is preferably used.

In mixing the reductant solution containing nuclei above described and the silver solution for particle growth, it is preferable that each solution is separately supplied into a reaction tube and mixed by using a static mixer arranged in the tube.

The silver powder in accordance with the present invention is silver powder obtained by the method for producing silver powder described above, which has an average particle diameter of 0.3 to 2.0 μm observed with a scanning electron microscope and a relative standard deviation (standard deviation σ/average particle diameter d) of the particle diameter is preferable 0.3 or less, and more preferable 0.25 or less.

EFFECTS OF INVENTION

The method for producing silver powder in accordance with the present invention enables to produce silver powder having a homogeneous particle diameter and containing no particulate. Thus, silver powder produced by this method can be suitably used as silver powder for pastes such as resin silver pastes and calcined silver pastes which are employed for forming wiring layers, electrodes and the like of electronic devices.

Additionally, the method for producing silver powder in accordance with the present invention enables to control easily particle diameter of silver powder and has excellent mass-productivity, and is of great industrial value.

DETAILED DESCRIPTION OF THE INVENTION

Figure 1:
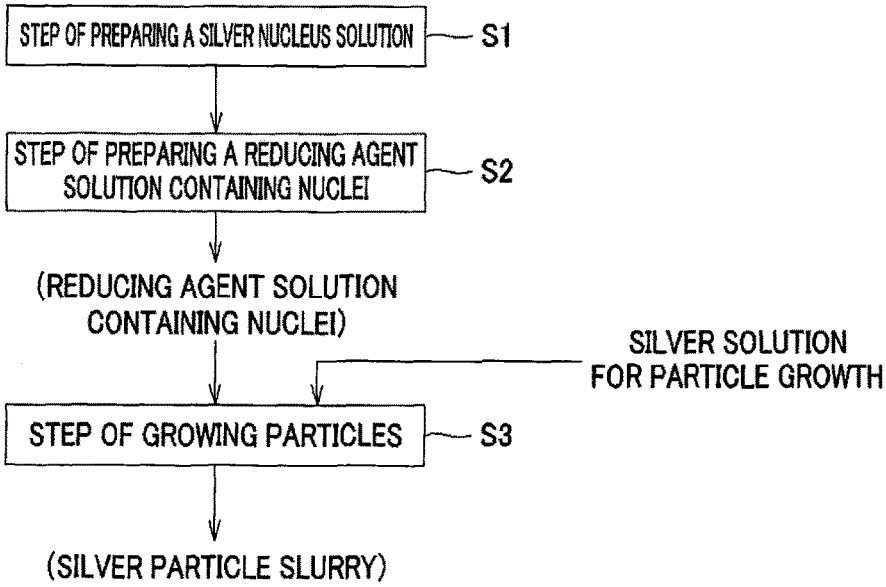
FIG. 1 is a process chart of a method for producing silver powder.

Specific embodiments of the method for producing silver powder and silver powder produced by the production method in accordance with the present invention will be described hereinbelow in detail. It should be noted that the present invention is not limited to the following embodiments and may be modified as appropriate without departing from the gist of the present invention.

The method for producing silver powder in accordance with the present embodiment is a method in which a silver solution containing a silver complex and a reductant solution are continuously mixed to provide a reaction liquid, the silver complex in the reaction liquid is reduced to obtain a silver particle slurry, and then, silver powder is produced via filtration, washing, and drying steps. The method allows the reductant solution to include silver nuclei to thereby enable providing silver powder which is homogeneous and has a desired particle diameter.

Conventionally, processes for reducing a silver salt as a raw material had problems with particle homogeneity. However, the study of the present inventors have found that addition of silver nuclei to the reductant solution is effective for obtaining homogeneous particles having a desired particle diameter and that nucleation and particle growth thereafter can be controlled by the standard electrode potential of the reductant.

Specifically, a silver nucleus solution obtained by mixing a solution containing a strong reductant, a solution for nucleation containing a silver complex, and a dispersant are mixed with a weak reductant having a standard electrode potential higher than that of the strong reductant to thereby provide a reductant solution containing nuclei. Then, this reductant solution containing nuclei is mixed with a silver solution for particle growth containing a silver complex followed by reduction. This enables silver powder having a homogeneous particle diameter to be obtained.

A strong reductant herein means a reductant having a strong reduction power, and a weak reductant means a reductant having a standard electrode potential higher than that of the strong reductant, that is, a reductant having a weak reducing power.

Alternatively, the method for producing silver powder in accordance with the present embodiment allows a reductant solution containing nuclei obtained by mixing a silver nucleus solution containing nuclei and a reductant and silver solution for particle growth containing a silver complex to be supplied quantitatively and continuously into a certain space, causes reduction reaction by mixing the solutions, and allows a post-reduction liquid after the reduction reaction, that is, a silver particle slurry to be discharged quantitatively and continuously. Such quantitative and continuous supply of respective solution to be reduced keeps the concentrations of the silver complex and the reductant at the reduction reaction site constant to thereby facilitate particle growth to a certain extent. This enables silver particles of a same size to be obtained, achieving silver powder having a narrow particle size distribution. Additionally, supply of the silver solution and the reductant solution and discharge of the silver particle slurry are carried out continuously to thereby enable silver powder to be continuously obtained and to be produced at high productivity.

Also in this method for producing silver powder, it is preferably to use silver chloride as a silver compound, which is a starting material, for example, a silver complex obtained by dissolving silver chloride in ammonia water. A nitrous acid-gas recovery equipment is not required by using silver chloride as a starting material while the equipment is required in case of using silver nitrate as a starting material, and use of silver chloride as a starting material allows a process to have a lower impact on the environment, and can reduce the production cost. It should be noted that, from the viewpoint described above, it is preferable that silver chloride is used in both of a silver solution for nucleation and a silver solution for particle growth.

The method for producing silver powder in accordance with the present embodiment will be described hereinbelow in more detail in each step.

The method for producing silver powder in accordance with the present embodiment includes, as shown in the process chart of FIG. 1, a step of preparing a silver nucleus solution S1 to obtain a silver nucleus solution, a step of preparing a reductant solution containing nuclei S2 to mix the silver nucleus solution obtained and a reductant to thereby obtain a reductant solution containing nuclei, and a step of growing particles S3 to mix the reductant solution containing nuclei and a silver solution for particle growth containing a silver complex, which is reduced to thereby grow the silver particles.

In this method for producing silver powder, it is important that the silver nucleation by using a strong reductant and the particles growth by using a weak reductant are carried out and that the silver nucleation and the particle growth are separated. Additionally, it is important that a reductant used for the silver nucleation and the one used for the particle growth have different standard electrode potentials. In the case where a strong reductant and a weak reductant are added to a silver solution at the same time, nucleation and particle growth cannot be sufficiently separated. Thus, new nucleation occurs during particle growth from the silver nuclei, and particulates are incorporated. As the result, silver particles having a sufficiently homogeneous particle diameter cannot be obtained. In contrast, after nuclei having a homogeneous particle diameter are formed by using a strong reductant, a weak reductant is added to produce a reductant solution. The reductant solution and a silver solution are mixed to undergo particle growth, and thus, silver particles having a homogeneous particle diameter can be obtained.

[Step of Preparing a Silver Nucleus Solution]

A step of preparing a silver nucleus solution S1 forms a solution of silver nuclei to be nuclei for particle growth. Specifically, in this step of preparing a silver nucleus solution S1, a silver solution for nucleation containing a silver complex is added to a solution containing a strong reductant and a dispersant obtained by mixing the dispersant and a solution containing the strong reductant followed by reduction to thereby obtain a silver nucleus solution. Alternatively, a silver solution for nucleation containing a silver complex is mixed with a dispersant in advance, and then a solution containing a strong reductant is added followed by reduction. The dispersant may be present in the solution at the time of silver nucleation, may be mixed with at least one of the silver solution for nucleation or the solution containing a strong reductant, or may be mixed with a dispersant when the silver solution for nucleation and the solution containing a strong reductant are mixed.

The strong reductant is a reductant having the strong reducing power as mentioned above, and preferably a reductant having a standard electrode potential of 0.056 V or less. Specifically, hydrazine (−1.15 V), formalin (0.056 V) and the like may be preferably used. Of these, hydrazine and hydrates thereof, which particularly have a strong reducing power, are preferably used, and hydrazine monohydrate is more preferably used. Use of such a reductant having a standard electrode potential of 0.056 V or less and a strong reducing power enables fine homogeneous silver particle suitable as nuclei to be obtained. If a reductant having a standard electrode potential of over 0.056 V and a weak reducing power is used, the reduction rate is decreased, and thus particle growth may progress simultaneously with nucleation. Nuclei having a homogeneous particle diameter cannot be obtained as well as the particle diameter is increased. Therefore, it is not possible to obtain silver particulates preferable as nuclei.

The amount of the strong reductant to be mixed is preferably 1.0 equivalent or more and less than 4.0 equivalents, and more preferably 2.0 equivalents or more and less than 4.0 equivalents with respect to the amount of silver in the silver solution for nucleation. The amount of the strong reductant to be mixed in this range can lead to formation of silver nuclei which are homogeneous and do not precipitate in the silver nucleus solution. As mentioned below, when a reductant solution obtained by mixing the silver nucleus solution with a weak reductant is mixed with a silver solution for particle growth, silver powder having a homogeneous particle diameter can be obtained. More preferably, when the strong reductant within a range of 2.0 equivalents or more and less than 4.0 equivalent with respect to the amount of silver in the silver solution for nucleation is mixed, fine silver nuclei having a more homogeneous particle diameter can be obtained.

In the case where the amount of the strong reductant to be mixed is less than 1.0 equivalent with respect to the amount of silver in the silver solution for nucleation, silver nucleus particles are prone to bond and precipitate. Thus, the number of nuclei during particle growth varies, and the particle diameter may not be sufficiently controlled. Additionally, because the silver nuclei have non-homogeneous particle diameter, growth becomes non-homogeneous during particle growth, and thus silver powder having a homogeneous particle diameter may not be obtained. In contrast, in the case where an amount of the strong reductant to be mixed is 4.0 equivalents or more, it is not preferable because coarse particles may be formed in the silver nucleus solution.

The dispersant is preferably at least one selected from polyvinyl alcohol, polyvinyl pyrrolidone, modified silicone oil surfactants, and polyether surfactants. In the case where dispersant is not used, silver nuclei formed by reduction reaction and silver particles grown from nuclei aggregate, so that dispersibility becomes insufficient.

The amount of the dispersant to be mixed is preferably 1 to 30% by mass and more preferably 1.5 to 20% by mass with respect to the amount of silver in the silver solution for particle growth after mixing of a reductant solution containing nuclei and a silver solution for particle growth as mentioned below, that is, the amount of silver to be used for particle growth obtained by subtracting the amount of silver in the reductant solution containing nuclei from the amount of silver in the reaction liquid. An amount to be mixed less than 1% by mass cannot achieve a sufficient suppressing effect of an aggregation, whereas an amount to be mixed over 30% by mass does not enhance a suppressing effect of an aggregation, so that the loads from effluent treatment and the like only increases. It should be noted that since the amount of silver in the silver solution for nucleation is smaller than that in the silver solution for particle growth, addition of the amount of the dispersant mentioned above added to the silver solution for nucleation in advance enables a sufficient suppressing effect of an aggregation to be achieved also during nucleation.

Since use of polyvinyl alcohol or polyvinyl pyrrolidone as the dispersant may cause foaming during reduction reaction, an anti-foaming agent may be added to a silver solution mentioned below, for example.

A silver solution for nucleation is a solution containing a silver complex which is obtained by dissolving a silver compound by a complexing agent. The solution is used for forming silver nuclei by mixing the strong reductant and the dispersant mentioned above followed by reduction.

As the silver compound, silver chloride is preferably used as mentioned above. Use of silver chloride reduces problems such as gas recovery and environmental influences as in the case where silver nitrate is used as a starting material. As such silver chloride, high purity silver chloride for industrial use is stably produced. Dissolution of such silver chloride in, for example, ammonia water provides a silver solution. Ammonia water used to dissolve silver chloride may be usual one used for industrial use, but in order to prevent impurity incorporation, the ammonia water is preferably as pure as possible.

The molar ratio of the amount of ammonia with respect to the amount of silver in the silver solution for nucleation is preferably 20 to 100. In the case where the molar ratio of the amount of ammonia with respect to the amount of silver is less than 20, by using silver chloride, it is difficult for silver chloride to dissolve in ammonia water. Thus, dissolved residue of silver chloride generates to serve as non-homogeneous nuclei, and the particle diameter of the resulting silver particles may become non-homogeneous. In contrast, in the case where the molar ratio of the amount of ammonia with respect to the amount of silver is over 100, it is not preferable because the nucleation reaction rate is decreased, so that it takes long time until reduction is completed.

The silver concentration in the silver solution for nucleation is preferably 0.1 to 6.0 g/L. In the case where a silver concentration is less than 0.1 g/L, particle diameter of silver powder may become too large because sufficient nuclei are not formed with respect to the amount of silver in the silver solution for particle growth mentioned below. In contrast, in the case where the silver concentration exceeds 6.0 g/L, the particles grow with nucleation, and silver nuclei of a homogeneous particle diameter cannot be obtained. In order to suppress growth of nuclei and to obtain a silver nucleus solution in which silver nuclei having a finer and more homogeneous particle diameter are dispersed, the silver concentration is more preferably 1.0 g/L or less. From these, setting the silver concentration in a silver solution for nucleation to a range of preferably 0.1 to 6.0 g/L and more preferably 0.1 to 1.0 g/L allows nuclei formed per the amount of silver to have a fine and homogeneous particle diameter as well as allows the number of the nuclei to be approximately constant. Then, the ratio of the amount of silver in the silver solution for nucleation with respect to the amount of the silver in the silver solution for particle growth mentioned below enables control of the particle diameter of silver particles to be formed. The details are mentioned below.

In this way, in the step of preparing a silver nucleus solution S1, the solution containing a strong reductant, the dispersant, and the silver solution for nucleation mentioned above are mixed, and the strong reductant reduces the silver complex in the silver solution to thereby form silver particles which becomes nuclei for growth of silver particles in the step of growing particles S3 mentioned below.

It should be noted that, in the reduction reaction, the strong reductant mentioned above can be diluted with pure water and the like and used as an aqueous solution in order to control the homogeneity or the reaction rate of the reaction.

[Step of Preparing a Reductant Solution Containing Nuclei]

In the step of preparing a reductant solution containing nuclei S2, the silver nucleus solution prepared in the step of preparing a silver nucleus solution S1 and a reductant are mixed to thereby obtain a reductant solution containing nuclei. This reductant solution containing nuclei will serve as a reductant in the reduction reaction in the step of growing particles S3 mentioned below.

In the step of preparing a reductant solution containing nuclei S2, the reductant to be mixed with the silver nucleus solution is a weak reductant having a standard electrode potential higher than and a reducing power weaker than that of the strong reductant added in the step of preparing a silver nucleus solution S1 described above. Specifically, a weak reductant to be added is preferably a reductant of over 0.056 V, and use of ascorbic acid (0.058 V) is particularly preferred. This ascorbic acid is particularly preferred because it has mild reducing action, and thus particle growth from nuclei homogeneously progresses.

The difference in the standard electrode potentials between the strong reductant and the weak reductant is preferably 1.0 V or more. When the difference in the standard electrode potentials is small, new nuclei may be formed during mixing with the silver solution for particle growth described below, leading to mixture of particulates and heterogeneity in the particle diameter. In contrast, combination of a strong reductant and a weak reductant having standard electrode potentials between which the difference is 1.0 V or more can suppress nucleation in the particle growth stage and enables silver particles of a homogeneous particle diameter to be obtained.

The amount of the weak reductant to be added is preferably 1 to 3 equivalents with respect to the amount of silver in the silver solution for particle growth used for particle growth in the step of growing particles S3 described below. An amount added less than 1 equivalent with respect to the amount of silver in the silver solution for particle growth is not preferred because unreduced silver remains. In contrast, the amount to be added more than 3 equivalents is not preferred because the cost will be increased.

It should be noted that the reductant solution described above can be diluted with pure water and the like in order to allow the reaction to be homogeneous or to control the reaction rate in reduction reaction in the step of growing particles S3 described below.

[Step of Growing Particles]

In the step of growing particles S3, the reductant solution containing nuclei obtained in the step of preparing a reductant solution containing nuclei S2 and a silver solution for particle growth containing a silver complex are mixed to reduce the silver complex. This allows silver particles to grow to thereby obtain a silver particle slurry.

The silver solution for particle growth is a solution containing a silver complex obtained by dissolving a silver compound by using a complexing agent as with the silver solution for nucleation described above. This silver solution for particle growth is a solution which reduces the silver complex in the silver solution when mixed with the reductant solution containing nuclei prepared, grows particles based on the nuclei in the reductant solution, and forms a silver particle slurry.

An example of the silver compound in the silver solution for particle growth preferably used includes silver nitrate from the viewpoint that it scarcely causes problems such as gas recovery and environmental influences when silver chloride is used, as described above. Additionally, although specific causes are not known, use of silver chloride in combination with the production method using nuclei can both achieve high productivity and homogeneity of the particle diameter. Dissolution of this silver chloride in, for example, ammonia water enables a silver solution to be obtained. Ammonia water which dissolves silver chloride may be common one used for industrial use. In order to prevent impurity incorporation, the ammonia water is preferably as pure as possible.

The silver concentration in the silver solution for particle growth is preferably 20 to 90 g/L. Particle growth occurs to allow silver particles to be obtained even at a low silver concentration. However, at less than 20 g/L, the amount of effluent is increased to lead to higher cost, and additionally, it is not possible to produce silver powder with high productivity. In contrast, a silver concentration over 90 g/L is not preferred because the concentration is approaching the solubility of silver chloride in ammonia water and silver chloride may be reprecipitated. To equalize particle growth to thereby obtain silver particles of a homogeneous particle diameter, the silver concentration is preferably 50 g/L or less.

In the method for producing silver powder in accordance with the present embodiment, the particle diameter of silver powder to be obtained can be controlled by the ratio of the amount of silver in the reductant solution containing nuclei to be mixed, that is, the amount of silver in the silver solution for nucleation to the amount of silver in the silver solution for particle growth, and silver powder having a desired particle diameter can be easily obtained. That is, setting the silver concentration in the silver solution for nucleation within the range mentioned above allows the number of nuclei formed per the amount of silver to be approximately constant. Thus, the ratio of the amount of silver in the reductant solution containing nuclei, that is, the number of silver nuclei to the amount of silver in the silver solution for particle growth enables the particle diameter of the silver powder to be controlled. Additionally, in this method for producing silver powder, since nucleation and particle growth are separated, the range within which the number of nuclei in the reaction liquid can be controlled is expanded, allowing control of the particle diameter over a wide range. Therefore, silver powder can be obtained at a high silver concentration with high productivity. Specifically, to obtain silver powder having an average particle diameter of 0.3 to 2.0 μm observed by scanning electron microscopy, the amount of silver in the silver solution for particle growth is preferably form 50 to 1500 times, more preferably 50 to 500 times as much as the amount of silver in the silver solution for nucleation.

In the step of growing particles S3 herein, the reductant solution containing nuclei and the silver solution for particle growth containing a silver complex are quantitatively and continuously supplied and mixed as mentioned above to provide a reaction solution, in which the silver complex is reduced to allow silver particles to grow. In this way, quantitatively and continuously supplying followed by mixing allows the concentrations of the silver complex and the reductant at the reduction reaction site to be constant, so that particle growth to a certain extent can be promoted, and silver powder can be produced with high productivity. It should be noted that the silver solution for particle growth may be simply referred to as a silver solution and the reductant solution containing nuclei may be simply referred to as reductant solution in the following description.

As a reaction tube for continuously supplying and mixing a reductant solution containing nuclei and a silver solution for particle growth to reduce the silver complex, a reaction tube composed of a first supply tube for supplying a silver solution for particle growth (a silver-solution supply tube), a second supply tube for supplying the reductant solution containing nuclei (a reductant-solution supply tube), and a mixing tube for mixing a silver solution and a reductant solution can be employed. In this way, the reductant solution containing nuclei and the silver solution for particle growth are supplied separately in each reaction tube and mixed in the mixing tube to allow reduction reaction to occur. Specifically, a typical example of the reaction tube includes a Y-tube. A static mixer can be arranged at a position of the reaction tube, the position being inside the mixing tube and immediately after the solutions supplied from each supply tube are merged.

Although the shape and size of each supply tube and mixing tube are not particularly limited, cylindrical tubes are preferred in that such piping is easy to connect to each other. As for mixing tubes, cylindrical ones are also preferred because it is necessary to place a static mixer inside.

As the materials of the supply tubes for silver solutions and the materials for reductant solutions, those not to react with the silver solutions and those not to react with the reductant solution may be respectively selected from vinyl chloride, polypropylene, polyethylene and the like. Alternatively, it is important for materials of the mixing tubes not to react with silver solutions and reductant solutions and not to allow silver after reduction reaction to adhere from the viewpoint of selection. Thus, glass is preferable as the materials.

Materials of the static mixers are preferably glass, as with the mixing tubes. The number of elements in the static mixers is not particularly limited, the number, but very few elements are not preferred because reduction reaction does not proceed homogeneously, resulting in particulates. In contrast, extremely many elements are not preferred because unnecessary elongation of the mixing tubes will be required. Accordingly, it is preferable that materials are appropriately determined depending on the flow rate and flow velocity of each solution.

In the reaction tube, the reaction liquid of the silver solution and the reductant solution desirably flow through the mixing tube until the silver solution and a reductant solution are sufficiently stirred and mixed by use of the static mixer mentioned above to thereby completely finish the reduction reaction in the reaction liquid. Alternatively, a corrugated tube, for example, is connected to the downstream side of the static mixer to allow the reaction site to be elongated sufficiently so as to completely finish the reduction reaction. This can prevent an unreduced silver complex from remaining to form coarse silver particles.

Common metering pumps, small-pulsation pumps can preferably be used as a measure for supplying each of the silver solution for particle growth and the reductant solution containing nuclei to the reaction tube. As for the flow rates of the silver solution for particle growth and the reductant solution containing nuclei, one flow rate is preferably 10 times or less as much as the other flow rate. 10 times or more difference between the flow rates of each solution may pose a problem of making the solutions difficult to mix homogeneously. Alternatively, the flow velocity of each solution is preferably 0.1 L/minute or more and 10 L/minute or less. A flow velocity less than 0.1 L/minute is not preferred because the productivity will be decreased. In contrast, a flow velocity more than 10 L/minute is not preferred because the solution is difficult to mix homogeneously.

After the silver solution and the reductant solution are mixed and the reduction reaction is finished in the reaction tube, the reaction liquid is preferably received in a predetermined vessel temporarily (hereinbelow, the vessel is referred to as the "receiving vessel"). Stirring is required in the receiving vessel so as not to settle the silver particles formed by reduction. Settling of silver particles is not preferred because silver particles form aggregates with each other to decrease the dispersibility. Stirring in the receiving vessel may be carried out at capacity to the extent that silver particles are not settled, and by use of a common stirrer. The reaction liquid entered the receiving vessel is fed via a pump to a filtering device such as filter presses, where the liquid can be continuously fed to the next step.

After a silver particle slurry formed as described above is filtered, it is washed and dried to thereby form silver powder.

An example of the washing method used includes, but is not particularly limited to, a method comprising placing silver particles in water, carrying out stirring by using a stirrer or an ultrasonic cleaner, and recovering the powder by filtration with a filter press and the like. In this washing method, the operation including placing into water, stirring and washing, and filtration is preferably carried out several times. Additionally, as water used for washing, water containing no impurities adverse to silver powder is used. In particular, pure water is preferably used.

Next, the silver powder washed is dried to evaporate water. An example of drying method includes, but is not particularly limited to, a method in which silver particles washed is arranged on a stainless tray and heated at approximately 40 to 80° C. in a commercially-available drying device such as an atmospheric oven and a vacuum dryer.

As described hereinabove in details, the method for producing silver powder as mentioned above enables production of silver powder containing no particulates and having a controlled homogeneous particle diameter. Specifically, the silver powder produced in accordance with this production method has an average particle diameter of the primary particles of 0.3 to 2.0 μm observed with a scanning electron microscope and a relative standard deviation (standard deviation σ/average particle diameter d) of the particle diameter is 0.3 or less, preferably of 0.25 or less. A primary particle herein refers to one considered to be a unit particle, judging from the appearance.

Such silver powder as is homogeneous and has a narrow particle diameter distribution may be suitably employed as silver powder for pastes such as resin silver pastes and calcined silver pastes used for forming wiring layers, electrodes and the like of electronic devices.

The method for producing silver powder in accordance with the present embodiment causes reduction reaction by quantitatively and continuously supplying a silver solution for particle growth and a reductant solution containing nuclei followed by mixing. Thus, the silver concentration in the reaction liquid is maintained constant, so that particle growth to a certain extent can be promoted, and silver powder having a more homogeneous particle diameter can be produced with high productivity. In this way, the method for producing silver powder in accordance with the present embodiment enables easy control of silver powder particle diameter, has excellent mass-productivity, and is of great industrial value.

EXAMPLES

The present invention is described in further details based on examples and comparative examples, but it is not limited to any of these examples.

Example 1

2.88 g of silver chloride (manufactured by Sumitomo Metal Mining Co., Ltd.) was fed into a mixture of 66 mL of 25% by mass ammonia water and 1.22 L of pure water maintained at a liquid temperature of 36° C. in a warm bath at 38° C. while being stirred to prepare a silver solution for nucleation (the silver concentration in the solution was 1.8 g/L, and the molar ratio of ammonia to the amount of silver was 44). Subsequently, 43 g of a dispersant, polyvinyl alcohol (manufactured by KURARAY CO., LTD., PVA205) was dissolved in 7.33 L of pure water at 36° C. To this, 0.91 mL (3.6 equivalents with respect to the amount of silver in the silver solution for nucleation) of a strong reductant, hydrazine monohydrate was added to thereby obtain a reductant solution, which was maintained at 36° C. in a warm bath. Then, to the reductant solution, the silver solution for nucleation was added at a flow rate of 64 mL/minute to form silver nuclei to thereby obtain a silver nucleus solution.

Next, to the silver nucleus solution obtained, 665 g (1.4 equivalents with respect to the amount of silver in silver solution for particle growth described below) of a weak reductant, ascorbic acid was added to thereby obtain a reductant solution containing nuclei.

Meanwhile, 842 g of silver chloride (manufactured by Sumitomo Metal Mining Co., Ltd.) was fed into 18 L of 25% by mass of ammonia water maintained at a liquid temperature of 32° C. in a warm bath at 33° C. with stirring and dissolved to obtain a salt-complex solution. Additionally, an anti-foaming agent (manufactured by ADEKA CORPORATION, ADEKA NOL LG-126) was diluted to 100 times by volume. A silver solution for particle growth (the silver concentration in the solution was 35 g/L) obtained by adding 8.3 mL of this diluted anti-foaming agent to the salt-complex solution was maintained in a warm bath at 32° C. It should be noted that the amount of polyvinyl alcohol added to the reductant solution containing nuclei above described was 3.8% by mass with respect to the amount of silver in the silver solution for particle growth.

The silver solution for particle growth and the reductant solution containing nuclei were respectively fed at 2.7 L/minute and 0.90 L/minute by using a tubing pump (manufactured by MASTERFLEX) and mixed to provide a reaction liquid. The silver complex was reduced in the reaction liquid to thereby obtain a silver particle slurry, which was pooled in a receiving vessel. After feed of the two solutions was finished, stirring was continued in the receiving vessel for 30 minutes.

The reaction liquid after stirring was filtered by using a filter press to solid-liquid separate the silver particles. Subsequently, the silver particles recovered was fed into 23 L of a 0.05 mol/L NaOH aqueous solution, to which 17.8 g of a stearic acid emulsion (manufactured by Chukyo Yushi Co., Ltd., Selosol 920) was added, stirred for 15 minutes, filtered by using a filter press and recovered. After the operation including placement into a 0.05 mol/L NaOH aqueous solution, stirring and filtration was repeated two more time, the silver particles recovered were fed into 23 L of pure water, and an operation including washing by stirring for 15 minutes and filtration by using a filter press was carried out. Then, the silver particles were transferred to a stainless tray and dried in a vacuum dryer at 60° C. for 10 hours to thereby obtain silver powder.

Figure 2:
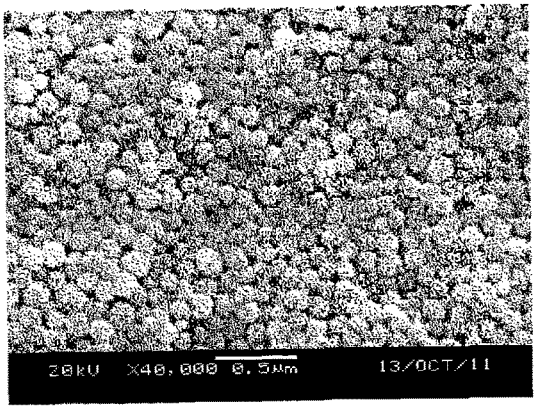
FIG. 2 is an SEM image of the silver nuclei obtained in Example 1.
Figure 3:
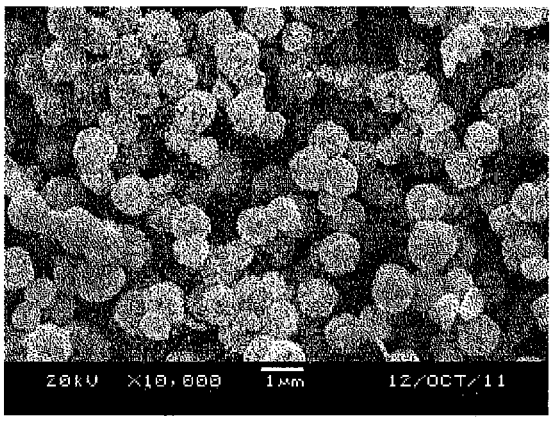
FIG. 3 is an SEM image of the silver powder obtained in Example 1.

A scanning electron microscope (SEM) image of the silver nuclei obtained is shown in FIG. 2, and an SEM image of the silver powder is shown in FIG. 3. As clearly seen from these SEM images, both the silver nuclei and silver powder obtained were composed of homogeneous particles. Additionally, the average particle diameter of the silver nuclei and silver powder, which were obtained by measuring the particle diameter of 300 or more of the primary particles from the SEM images, and dividing the particles sizes by the number of the particles, were each 0.11 μm and 0.81 μm. The relative standard deviation (standard deviation σ/average particle diameter d) of the particle diameter of the silver powder obtained from the measurement result was 0.18, confirming that the powder was homogeneous and included no particulates.

Example 2

1.11 g of silver chloride (manufactured by Sumitomo Metal Mining Co., Ltd.) was fed into a mixture of 25 mL of 25% by mass of ammonia water and 0.485 L of pure water maintained at a liquid temperature of 36° C. in a warm bath at 38° C. while being stirred to prepare a silver solution for nucleation (the silver concentration in the solution was 1.5 g/L, and the molar ratio of ammonia to the amount of silver was 44). Subsequently, 31 g of a dispersant, polyvinyl alcohol (manufactured by KURARAY CO., LTD., PVA205) was dissolved in 1.0 L of pure water at 36° C. To this, 0.12 mL (1.2 equivalents with respect to the amount of silver in the silver solution for nucleation) of a strong reductant, hydrazine monohydrate was added to thereby obtain a reductant solution, which was maintained at 36° C. in a warm bath. Then, to the reductant solution, the silver solution for nucleation was added at a flow rate of 20 mL/minute to form silver nuclei to thereby provide a silver nucleus solution.

Next, to the silver nucleus solution obtained, 103 g (1.4 equivalents with respect to the amount of silver in the silver solution for particle growth described below) of a weak reductant, ascorbic acid was added to thereby obtain a reductant solution containing nuclei.

Meanwhile, 175 g of silver chloride (manufactured by Sumitomo Metal Mining Co., Ltd.) was fed into 3.29 L of 25% by mass of ammonia water maintained at a liquid temperature of 36° C. in a warm bath at 38° C. while being stirred and was dissolved to thereby obtain a silver-complex solution. Additionally, an anti-foaming agent (manufactured by ADEKA CORPORATION, ADEKA NOL LG-126) was diluted to 100 times by volume. A silver solution for particle growth (the silver concentration in the solution was 35 g/L) obtained by adding 1.7 mL of this diluted anti-foaming agent to the silver-complex solution was maintained in a warm bath at 36° C. It should be noted that the amount of polyvinyl alcohol added to the reductant solution containing nuclei above described was 18% by mass with respect to the amount of silver in the silver solution for particle growth.

The silver solution for particle growth and the reductant solution containing nuclei were respectively fed at 2.4 L/minute and 0.80 L/minute by using a tubing pump (manufactured by MASTERFLEX) and mixed to provide a reaction liquid. The silver complex was reduced in the reaction liquid to obtain a silver particle slurry, which was pooled in a receiving vessel. After feed of the two solutions was finished, stirring was continued in the receiving vessel for 30 minutes.

The reaction liquid after stirring was filtered by using a membrane filter having an opening diameter of 0.3 μm to thereby solid-liquid separate the silver particles. Subsequently, the silver particles recovered was fed into 2 L of a 0.05 mol/L NaOH aqueous solution, to which 3.6 g of a stearic acid emulsion (manufactured by Chukyo Yushi Co., Ltd., Selosol 920) was added, stirred for 15 minutes, filtered by using a membrane filter having an opening diameter of 0.3 μm, and recovered. After the operation including placing into a 0.05 mol/L NaOH aqueous solution, stirring and filtration was repeated two more time, the silver particles recovered was fed into 2 L of pure water, and an operation including washing by stirring for 15 minutes and filtration with a filter press was carried out. Then, the silver particles were transferred to a stainless tray and dried in a vacuum dryer at 60° C. for 10 hours to thereby obtain silver powder.

Figure 4:
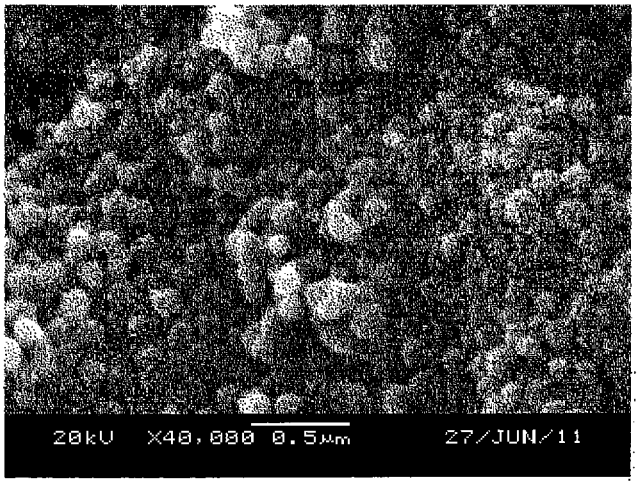
FIG. 4 is an SEM image of the silver nuclei obtained in Example 2.
Figure 5:
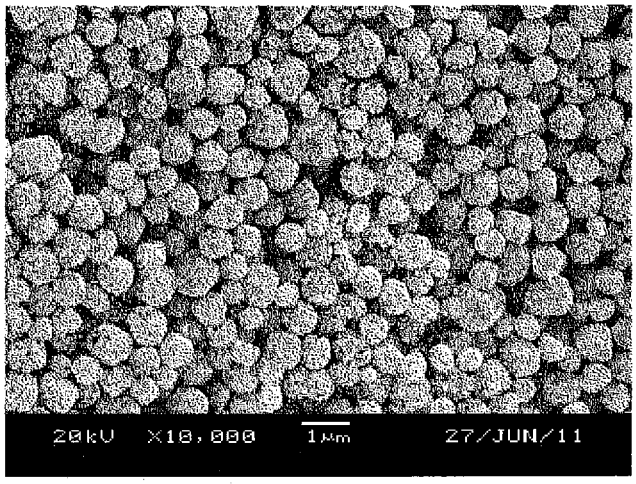
FIG. 5 is an SEM image of the silver powder obtained in Example 2.

An SEM image of the silver nuclei obtained is shown in FIG. 4, and an SEM image of the silver powder is shown in FIG. 5. As clearly seen from these SEM images, both the silver nuclei and silver powder obtained were composed of homogeneous particles. Additionally, the average particle diameter, which were obtained by measuring the particle diameter of 300 or more of the primary particles from the SEM images, and dividing the particles sizes by the number of the particles, were each 0.13 μm and 0.64 μm. The relative standard deviation (standard deviation σ/average particle diameter d) of the particle diameter of the silver powder obtained from the measurement result was 0.22, confirming that the powder was homogeneous and included no particulates.

Example 3

Silver powder was obtained and evaluated as in Example 2, except that 2.21 g of silver chloride used for the silver solution for nucleation, 50 mL of 25% ammonia water (the silver concentration in the solution was 3.0 g/L, and the molar ratio of ammonia to the amount of silver was 44), and 0.23 mL of a strong reductant, hydrazine monohydrate used for the reductant solution for silver nucleation (1.2 equivalents with respect to the amount of silver in the silver solution for nucleation) were added.

When observed with an SEM, both the silver nuclei and silver powder obtained were composed of homogeneous particles. Additionally, the average particle diameter of the silver nuclei and silver powder measured with SEM observation were each 0.14 μm and 0.42 μm. The relative standard deviation (standard deviation σ/average particle diameter d) of the particle diameter of the silver powder obtained from the measurement result was 0.25, confirming that the powder was homogeneous and included no particulates.

Example 4

45.0 g of silver chloride (manufactured by Sumitomo Metal Mining Co., Ltd.) was fed into a mixture of 1025 mL of 25% by mass of ammonia water and 175 L of pure water at 36° C. while being stirred and was dissolved. 1350 g of a dispersant, polyvinyl alcohol (manufactured by KURARAY CO., LTD., PVA205) dissolved in 50 L of pure water at 50° C. was fed into the above mentioned solution to thereby obtain a silver solution for nucleation (the silver concentration in the solution was 0.15 g/L, and the molar ratio of ammonia to the amount of silver was 45), which was maintained at 36° C. Next, 9.72 mL of a strong reductant, hydrazine monohydrate (2.5 equivalents with respect to the amount of silver in the silver solution for nucleation) was added to 37.6 L of pure water to thereby obtain a reductant solution, which was maintained at 36° C. Then, to the silver solution for nucleation, the reductant solution was added at a flow rate of 630 mL/minute to form silver nuclei to thereby provide a silver nucleus solution.

Next, to the silver nucleus solution obtained, 20.5 kg (1.4 equivalents with respect to the amount of silver in silver solution for particle growth described below) of a weak reductant, ascorbic acid and 69 L of pure water were added to provide a reductant solution containing nuclei.

Meanwhile, 12.6 kg of silver chloride (manufactured by Sumitomo Metal Mining Co., Ltd.) was fed into 270 L of 25% by mass of ammonia water maintained at a liquid temperature of 32° C. while being stirred and was dissolved to obtain a silver-complex solution. Additionally, an anti-foaming agent (manufactured by ADEKA CORPORATION, ADEKA NOL LG-126) was diluted to 100 times by volume. A silver solution for particle growth (the silver concentration in the solution was 35 g/L) obtained by adding 124 mL of this diluted anti-foaming agent to the silver-complex solution was maintained in a warm bath at 32° C. It should be noted that the amount of polyvinyl alcohol added to the reductant solution containing nuclei above described was 3.8% by mass with respect to the amount of silver in the silver solution for particle growth.

The silver solution for particle growth and the reductant solution containing nuclei were respectively fed at 2.7 L/minute and 0.90 L/minute by using a tubing pump (manufactured by MASTERFLEX) and mixed to provide a reaction liquid. The silver complex was reduced in the reaction liquid to obtain a silver particle slurry, which was pooled in a receiving vessel. After feed of the two solutions was finished, stirring was continued in the receiving vessel for 30 minutes.

The reaction liquid after stirring was filtered by using a filter press to solid-liquid separate the silver particles. Subsequently, the silver particles recovered was fed into 114 L of a 0.05 mol/L NaOH aqueous solution, to which 162 g of a stearic acid emulsion (manufactured by Chukyo Yushi Co., Ltd., Selosol 920) was added, stirred for 15 minutes, filtered by using a filter press, and recovered. After the operation including placement into a 0.05 mol/L NaOH aqueous solution, stirring and filtration was repeated two more time, the silver particles recovered was fed into 114 L of pure water, and an operation including washing by stirring for 15 minutes and filtration with a filter press was carried out. Then, the silver particles were transferred to a stainless tray and dried in a vacuum dryer at 60° C. for 10 hours to thereby obtain silver powder.

Figure 6:
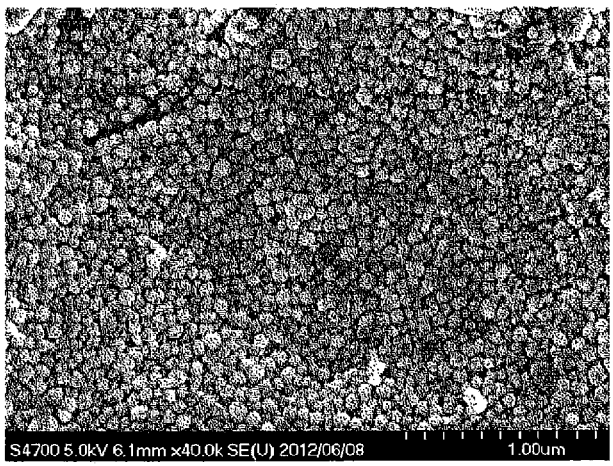
FIG. 6 is an SEM image of the silver nuclei obtained in Example 4.
Figure 7:
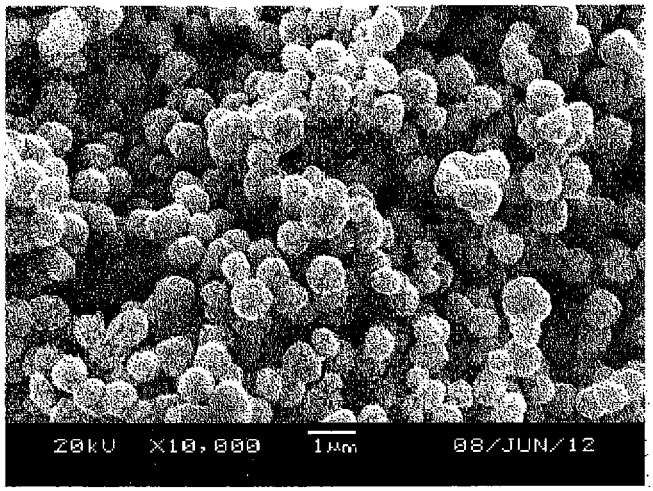
FIG. 7 is an SEM image of the silver powder obtained in Example 4.

An SEM image of the silver nuclei obtained is shown in FIG. 6, and an SEM image of the silver powder shown in FIG. 7. As seen from these SEM images, both the silver nuclei and silver powder obtained were composed of homogeneous particles. Additionally, the average particle diameter of the silver nuclei and silver powder, which were obtained by measuring the particle diameter of 300 or more of the primary particles from the SEM images, and dividing the particles sizes by the number of the particles, were each 0.068 μm and 0.68 μm. The relative standard deviation (standard deviation σ/average particle diameter d) of the particle diameter of the silver powder obtained from the measurement result was 0.20, confirming that the powder was homogeneous and included no particulates.

Example 5

2.92 g of silver chloride (manufactured by Sumitomo Metal Mining Co., Ltd.) was fed into a mixture of 60 mL of 25% by mass of ammonia water and 0.5 L of pure water at maintained 36° C. while being stirred and was dissolved. 43.6 g of a dispersant, polyvinyl alcohol (manufactured by KURARAY CO., LTD., PVA205) dissolved in 6.76 L of pure water at 50° C. was fed into the above mentioned solution to thereby obtain a silver solution for nucleation (the silver concentration in the solution was 0.30 g/L, and the molar ratio of ammonia to the amount of silver was 40), which was maintained at 36° C. Next, 0.63 mL of a strong reductant, hydrazine monohydrate (2.5 equivalents with respect to the amount of silver in the silver solution for nucleation) was added to 1.22 L pure water to thereby obtain a reductant solution, which was maintained at 36° C. Then, to the silver solution for nucleation, the reductant solution was added at a flow rate of 60 mL/minute to form silver nuclei to thereby provide a silver nucleus solution.

Next, to the silver nucleus solution obtained, 1261 g (1.4 equivalents with respect to the amount of silver in silver solution for particle growth described below) of a weak reductant, ascorbic acid and 2.21 L of pure water were added to provide a reductant solution containing nuclei.

Meanwhile, 1587 g of silver chloride (manufactured by Sumitomo Metal Mining Co., Ltd.) was fed into 18 L of 25% by mass of ammonia water maintained at a liquid temperature of 32° C. while being stirred and was dissolved to obtain a silver-complex solution. Additionally, an anti-foaming agent (manufactured by ADEKA CORPORATION, ADEKA NOL LG-126) was diluted to 100 times by volume. A silver solution for particle growth (the silver concentration in the solution was 67 g/L) obtained by adding 15.6 mL of this diluted anti-foaming agent to the silver-complex solution was maintained in a warm bath at 32° C. It should be noted that the amount of polyvinyl alcohol added to the reductant solution containing nuclei above described was 2.0% by mass with respect to the amount of silver in the silver solution for particle growth.

The silver solution for particle growth and the reductant solution containing nuclei were respectively fed at 2.7 L/minute and 0.90 L/minute by using a tubing pump (manufactured by MASTERFLEX) and mixed to provide a reaction liquid. The silver complex was reduced in the reaction liquid to thereby obtain a silver particle slurry, which was pooled in a receiving vessel. After feed of the two solutions was finished, stirring was continued in the receiving vessel for 30 minutes.

The reaction liquid after stirring was filtered by using a filter press to solid-liquid separate the silver particles. Subsequently, the silver particles recovered was fed into 17 L of a 0.05 mol/L NaOH aqueous solution, to which 20.4 g of a stearic acid emulsion (manufactured by Chukyo Yushi Co., Ltd., Selosol 920) was added, stirred for 15 minutes, filtered by using a filter press, and recovered. After the operation including placement into a 0.05 mol/L NaOH aqueous solution, stirring and filtration was repeated two more time, the silver particles recovered was fed into 17 L of pure water, and an operation including washing by stirring for 15 minutes and filtration with a filter press was carried out. Then, the silver particles were transferred to a stainless tray and dried in a vacuum dryer at 60° C. for 10 hours to thereby obtain silver powder.

Figure 8:
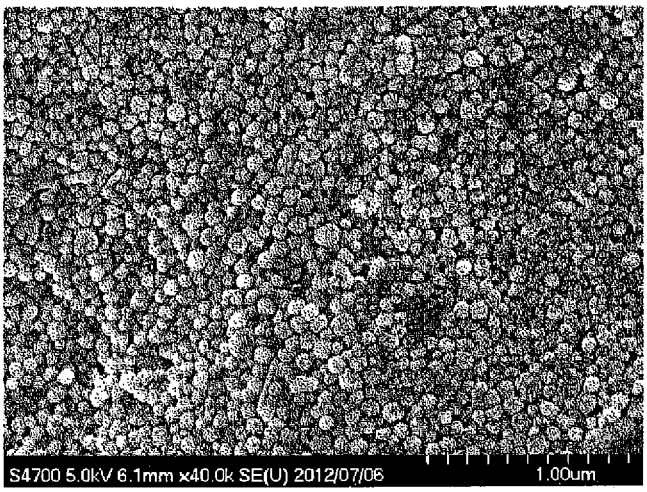
FIG. 8 is an SEM image of the silver nuclei obtained in Example 5.
Figure 9:
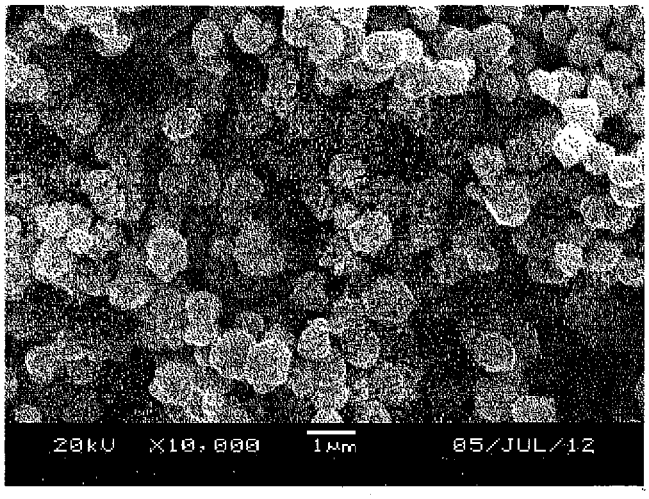
FIG. 9 is an SEM image of the silver powder obtained in Example 5.

An SEM image of the silver nuclei obtained is shown in FIG. 8, and an SEM image of the silver powder is shown in FIG. 9. As clearly seen from these SEM images, both the silver nuclei and silver powder obtained were composed of homogeneous particles. Additionally, the average particle diameter of the silver nuclei and silver powder, which were obtained by measuring the particle diameter of 300 or more of the primary particles from the SEM images, and dividing the particles sizes by the number of the particles, were each 0.072 μm and 0.68 μm. The relative standard deviation (standard deviation σ/average particle diameter d) of the particle diameter of the silver powder obtained from the measurement result was 0.19, confirming that the powder was homogeneous and included no particulates.

Example 6

Silver powder was obtained and evaluated as in Example 2, except that 45 mL of 25% by mass of ammonia water used for the silver solution for nucleation, 1513 g of ascorbic acid used for the reductant solution containing nuclei, 1904 g of silver chloride used for the silver solution for particle growth, 20 L of an NaOH aqueous solution, and 24.4 g of a stearic acid emulsion were used (the silver concentration in the silver solution for nucleation was 0.30 g/L and the molar ratio of ammonia to the amount of silver was 30, the silver concentration in the silver solution for particle growth was 80 g/L, and the amount of polyvinyl alcohol added in the silver solution for particle growth with respect to the amount of silver was 1.7% by mass).

Figure 10:
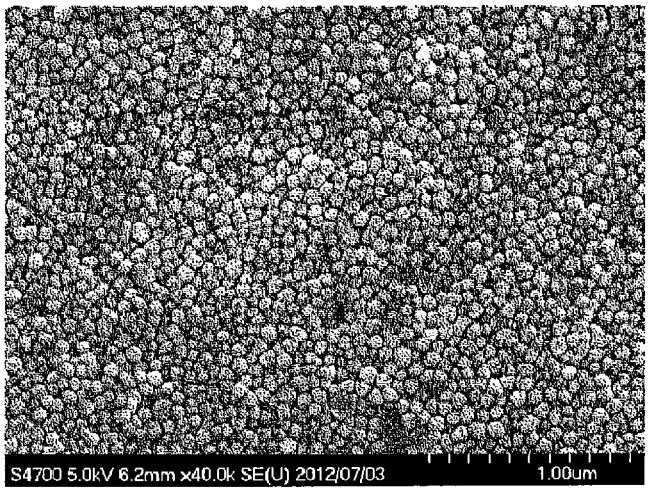
FIG. 10 is an SEM image of the silver nuclei obtained in Example 6.
Figure 11:
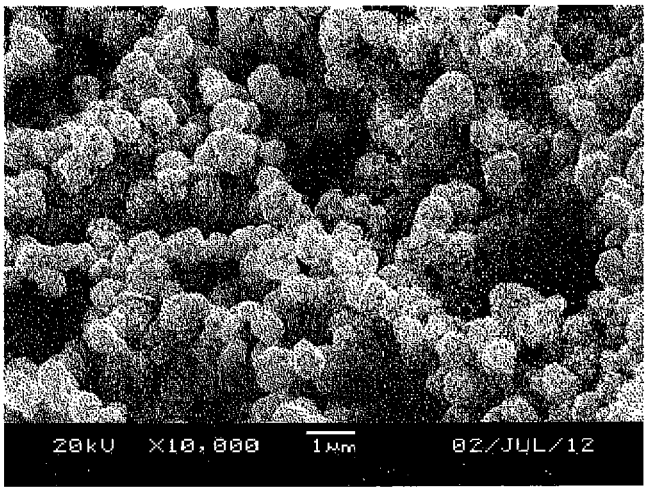
FIG. 11 is an SEM image of the silver powder obtained in Example 6.

An SEM image of the silver nuclei obtained is shown in FIG. 10, and an SEM image of the silver powder is shown in FIG. 11. As clearly seen from these SEM images, both the silver nuclei and silver powder obtained were composed of homogeneous particles. Additionally, the average particle diameter of the silver nuclei and silver powder, which were obtained by measuring the particle diameter of 300 or more of the primary particles from the SEM images, and dividing the particles sizes by the number of the particles, were each 0.065 μm and 0.65 μM. The relative standard deviation (standard deviation σ/average particle diameter d) of the particle diameter of the silver powder obtained from the measurement result was 0.20, confirming that the powder was homogeneous and included no particulates.

Comparative Example 1

Silver powder was obtained as in Example 1, except that 31 g of the dispersant, polyvinyl alcohol (manufactured by KURARAY CO., LTD., PVA205) was dissolved in 1.0 L of pure water at 36° C. and that a reductant solution to which 103 g of the weak reductant, ascorbic acid was added and a silver solution for particle growth were each fed and used as a reaction liquid. That is, in Comparative Example 1, a silver nucleus solution was not added to the reductant solution, and silver particles were not formed by reduction reaction using nuclei.

Figure 12:
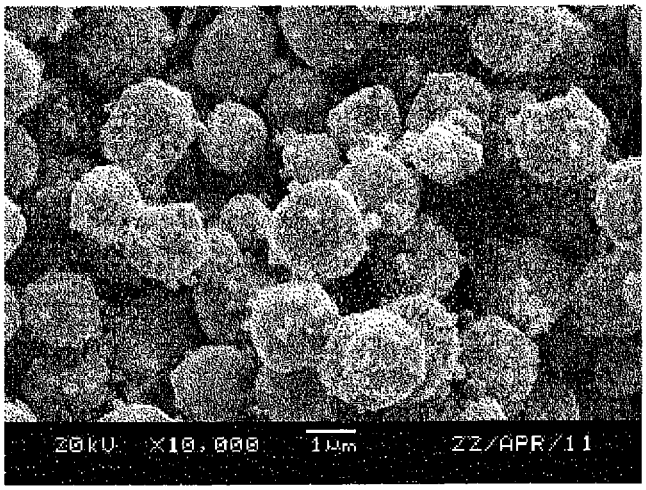
FIG. 12 is an SEM image of the silver powder obtained in Comparative Example 1.

The silver powder obtained was evaluated as in Example 1. An SEM image of the silver powder obtained is shown in FIG. 12. As clearly seen from the SEM image, fine silver particles have been generated. Additionally, the average particle diameter of the silver powder obtained was 0.34 μm, and the relative standard deviation (standard deviation σ/average particle diameter d) of the particle diameter of the silver powder obtained from the measurement result was 1.29. Many particulates were formed in this way, and the particle diameter distribution was broad and was non-homogenous.

Reference Example 1

A silver nucleus solution was obtained as in Example 5, except that 14.6 g of the silver chloride and 150 mL of 25% by mass of ammonia water (the silver concentration in the silver solution for nucleation was 1.5 g/L and the molar ratio of ammonia to the amount of silver was 20) used for the silver solution for nucleation, and 6.33 mL of hydrazine used for silver nucleation were used.

The silver nuclei obtained are precipitated. In order to allow the precipitated nuclei to serve as nuclei, it is necessary to redisperse the silver nuclei homogeneously in the reductant solution containing nuclei. Thus, the silver concentration in the silver solution for nucleation is preferably 0.1 g/L or less.

Reference Example 2

A silver nucleus solution was obtained as in Example 4, except that 90.2 g of the silver chloride and 5600 mL of 25% by mass of ammonia water (the silver concentration in the silver solution for nucleation was 0.3 g/L and the molar ratio of ammonia to the amount of silver was 120) used for the silver solution for nucleation, 2700 g of polyvinyl alcohol, and 19.44 mL of hydrazine used for silver nucleation were used.

Figure 13:
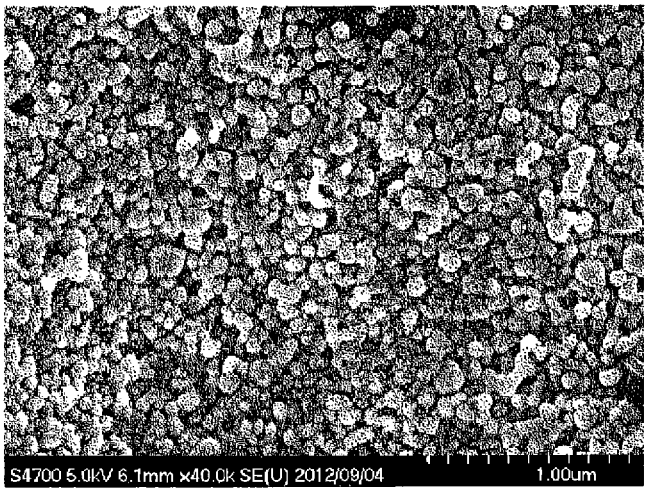
FIG. 13 is an SEM image of the silver nuclei obtained in Reference Example 2.

The reaction did not finish although the solution was maintained for one hour after addition of hydrazine. After ascorbic acid was added to the solution, and the silver nuclei were confirmed to be bonded to each other, as shown in an SEM image in FIG. 13. When the amount of ammonia is increased like this, it takes a long time for nucleation, and the productivity is decreased. In contrast, when the weak reductant is added before the reaction is finished, the homogeneity of the nuclei is decreased. Alternatively, when the silver nuclei were bonded and particle diameter were non-homogeneous, the homogeneity of the particle diameter of silver powder ultimately obtained may be affected. Accordingly, the molar ratio of the amount of ammonia to the amount of silver in the silver solution for nucleation is preferably 100 or less.

The invention claimed is:

1. A method for producing silver powder wherein a silver solution containing a silver complex and a reductant solution are continuously mixed to provide a reaction liquid, in which the silver complex is reduced to obtain a silver particle slurry, and then, silver powder is produced via steps of filtration, washing, and drying, the method comprising:

a step of preparing a silver nucleus solution wherein a silver solution for nucleation containing a silver complex, a solution containing a strong reductant, and a dispersant are mixed to obtain the silver nucleus solution;

a step of preparing a reductant solution containing nuclei wherein the silver nucleus solution obtained and a weak reductant having a standard electrode potential higher than that of the strong reductant are mixed to obtain the reductant solution containing nuclei; and a step of growing particles wherein the reductant solution containing nuclei and a silver solution for particle growth containing a silver complex are continuously mixed to provide a reaction solution, in which the silver complex is reduced to thereby grow silver particles.

2. The method for producing silver powder according to claim 1, wherein the equivalent of the strong reductant is 2.0 or more and less than 4.0 with respect to the amount of silver in the silver solution for nucleation.

3. The method for producing silver powder according to claim 1, wherein the standard electrode potential of the strong reductant is 0.056 V or less.

4. The method for producing silver powder according to claim 1, wherein the difference of the standard electrode potentials between the strong reductant and the weak reductant is 1.0 V or more.

5. The method for producing silver powder according to claim 1, wherein the strong reductant is hydrazine monohydrate and the weak reductant is ascorbic acid.

6. The method for producing silver powder according to claim 1, wherein the silver concentration of the silver solution for nucleation is 0.1 to 6.0 g/L.

7. The method for producing silver powder according to claim 6, wherein the silver concentration of the silver solution for nucleation is 0.1 to 1.0 g/L, and the silver concentration of the silver solution for particle growth is 20 to 90 g/L.

8. The method for producing silver powder according to claim 1, wherein the silver complex is a silver ammine complex obtained by dissolving silver chloride in ammonia water.

9. The method for producing silver powder according to claim 8, wherein the molar ratio of the amount of ammonia with respect to the amount of silver in the silver solution for nucleation is 20 to 100.

10. The method for producing silver powder according to claim 1, wherein the amount of the dispersant to be mixed is 1 to 30% by mass with respect to the amount of silver in the silver solution for particle growth after mixing of the reductant solution containing nuclei and the silver solution for particle growth.

11. The method for producing silver powder according to claim 1, wherein the dispersant is at least one selected from the group consisting of polyvinyl alcohol, polyvinyl pyrrolidone, modified silicone oil surfactants, and polyether surfactants.

12. The method for producing silver powder according to claim 1, wherein, in mixing of the reductant solution containing nuclei and the silver solution for particle growth, each solution is separately supplied into a reaction tube and mixed by using a static mixer arranged in the tube.

* * * * *